US006766672B2

(12) United States Patent
Ling

(10) Patent No.: US 6,766,672 B2
(45) Date of Patent: Jul. 27, 2004

(54) COMBINATION LOCK

(75) Inventor: Renny Tse-Haw Ling, Chung-Ho (TW)

(73) Assignee: Sinox Company Limited, Taipei Hsien (TW)

( * ) Notice: Subject to any disclaimer, the term of this patent is extended or adjusted under 35 U.S.C. 154(b) by 0 days.

(21) Appl. No.: 10/306,344

(22) Filed: Nov. 29, 2002

(65) Prior Publication Data

US 2004/0103700 A1 Jun. 3, 2004

(51) Int. Cl.[7] ..... E05B 37/06
(52) U.S. Cl. ..... 70/25; 70/312
(58) Field of Search ..... 70/22–26, 312–314, 70/303 A, 303 R

(56) References Cited

U.S. PATENT DOCUMENTS 6,029,481 A * 2/2000 Lai ..... 70/25
6,086,223 A * 7/2000 Fogle et al. ..... 70/25 X
6,164,096 A * 12/2000 Lai ..... 70/25
6,381,997 B1 * 5/2002 Chen ..... 70/28
6,434,981 B2 8/2002 Fantl et al. ..... 70/25
6,470,718 B1 * 10/2002 Yang ..... 70/25 X
6,474,116 B1 * 11/2002 Lai ..... 70/25
6,615,626 B2 * 9/2003 Yu et al. ..... 70/312 X
2003/0000264 A1 * 1/2003 Yang ..... 70/25

* cited by examiner

*Primary Examiner*—Suzanne Dino Barrett
(74) *Attorney, Agent, or Firm*—Birch, Stewart, Kolasch & Birch, LLP

(57) ABSTRACT

A combination lock consists of a lock housing, a shackle, a lock shaft, an elastic element, a dial and a plurality of retaining rings. The dial is the only element for performing the locking and unlocking function, and forms rotational chain movements with the retaining rings such that the retaining rings may be driven by the dial to move the lock shaft to generate an interference or release movement, thereby indirectly determine whether the shackle may be moved relative to the lock housing from a locked position to an unlocked position.

18 Claims, 9 Drawing Sheets

COMBINATION LOCK

FIELD OF THE INVENTION

The present invention relates to a combination lock that is portable for locking luggage, lockers, doors and the like.

BACKGROUND OF THE INVENTION

Padlocks are widely used in various occasions to provide safety protection for goods and properties. At present there are many different types of padlocks available on the market. Their functions also arc enhanced and improved constantly.

Conventional padlocks can be classified in two types: padlocks with keys and combination locks. The former type requires mating keys to do unlocking and the later type has a mechanism to set unlocking password. While both types have their unique functions, to people who care about losing keys, the combination lock is a preferred choice.

Refer to FIG. 1 for a conventional combination lock. It has a plurality of visible number disks located in the lock housing. Each number disk has a set number (or character or pattern) to combine with other set numbers to form an unlocking number set. The lock can be unlocked only after all of the number disks have been turned and aligned to the preset numbers.

The design of multiple number disks has become one of the standards of the combination locks. However, the prolific choices of the dialing and unlocking mechanism increase the costs of materials, production and management. In addition, the exposed dialing disks also become a limitation of the exterior design.

SUMMARY OF THE INVENTION

In view of the aforesaid disadvantages, the primary object of the invention is to provide a lock that has a simpler structure and is easier to use.

In order to achieve the foregoing object, the invention provides an improved combination lock that employs only one dial to set the password with two or more numerals. The combination lock according to the invention includes a lock housing, a shackle, a lock shaft, an elastic element, a dial and a plurality of retaining rings. The dial is the only control element to perform the locking or unlocking function. It forms rotational chain movements with the retaining rings such that the retaining rings may generate a constraint or a release movement on the lock shaft to determine indirectly whether the shackle may be moved relative to the lock housing from a locked position to an unlocked position.

When in use, the dial and the retaining ring are engaged respectively with a turning wheel and a turning ring, and are coupled on a sleeve mounted onto the lock shaft. Moreover, the sleeve has one side connecting to an number alteration bolt. When the number alteration bolt is subjected to a force, it drives the sleeve to escape the turning ring so that the turning ring may change position and then couple with the sleeve again to achieve the function of password alteration.

The foregoing, as well as additional objects, features and advantages of the invention will be more readily apparent from the following detailed description, which proceeds with reference to the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
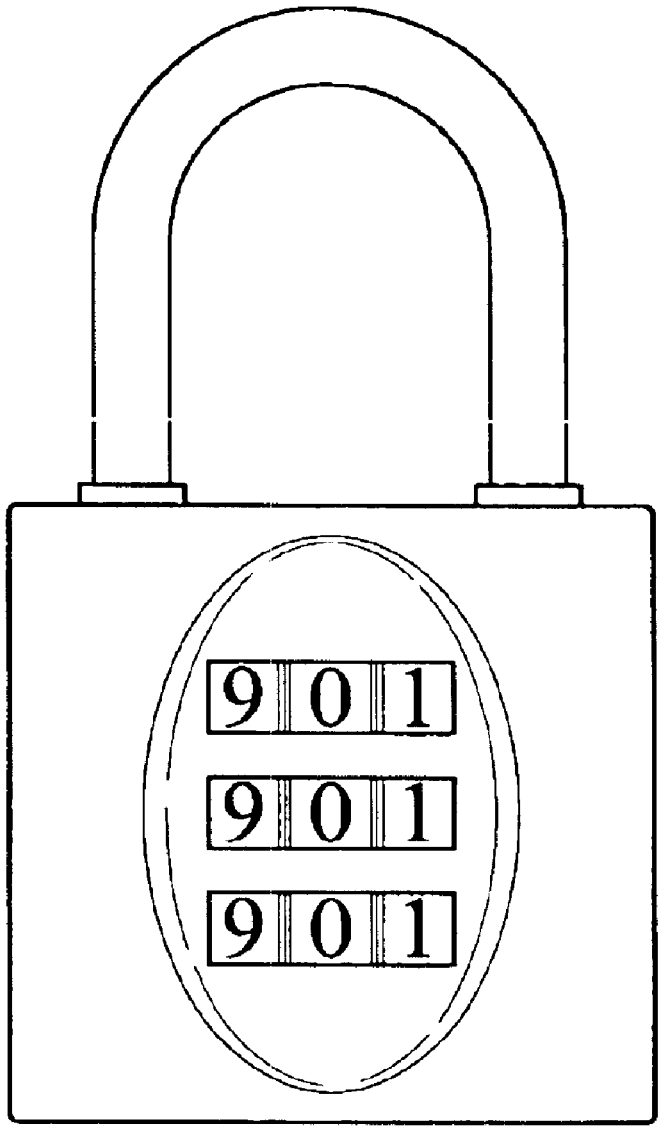
Fig.1 PRIOR ART
FIG. 1 is a front view of a conventional combination lock.
Figure 2A:
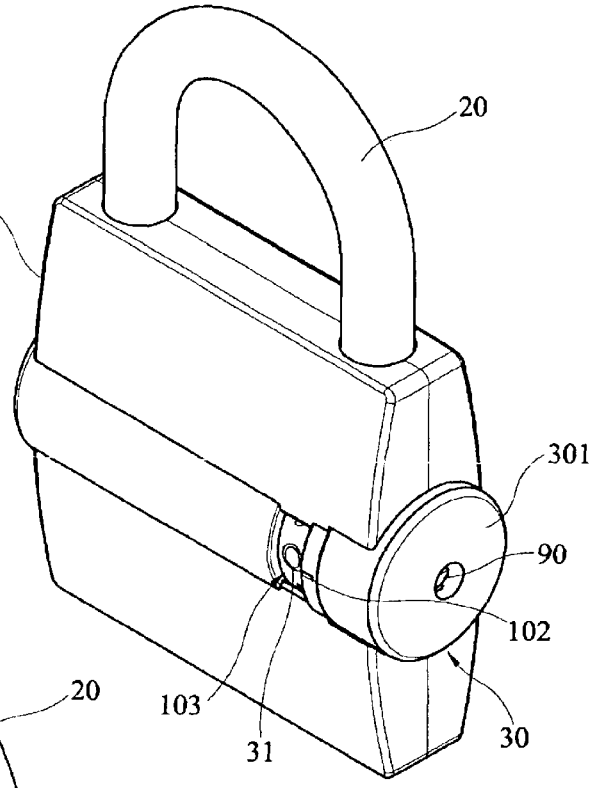
FIG. 2A is a perspective view of an embodiment of the invention.
Figure 2B:
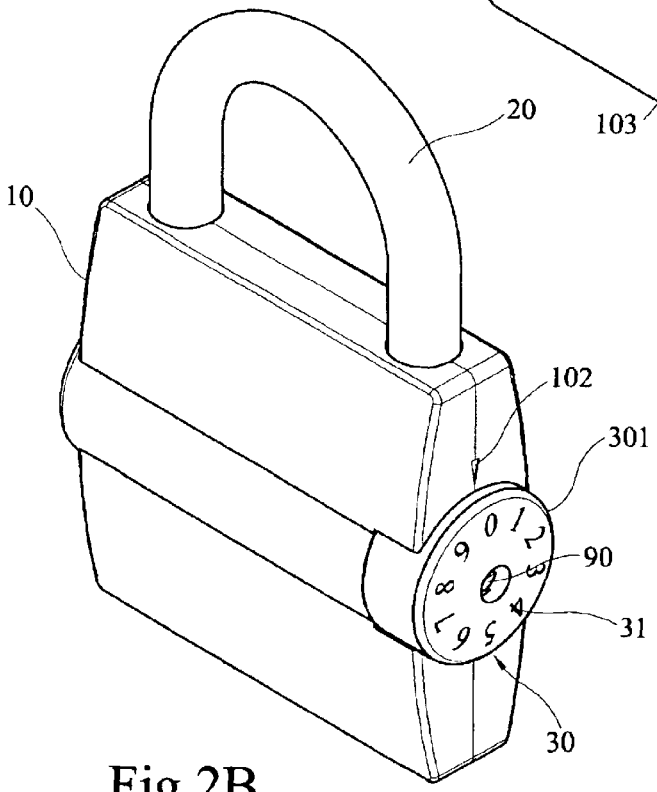
FIG. 2B is a perspective view of another embodiment of the invention.
Figure 3:
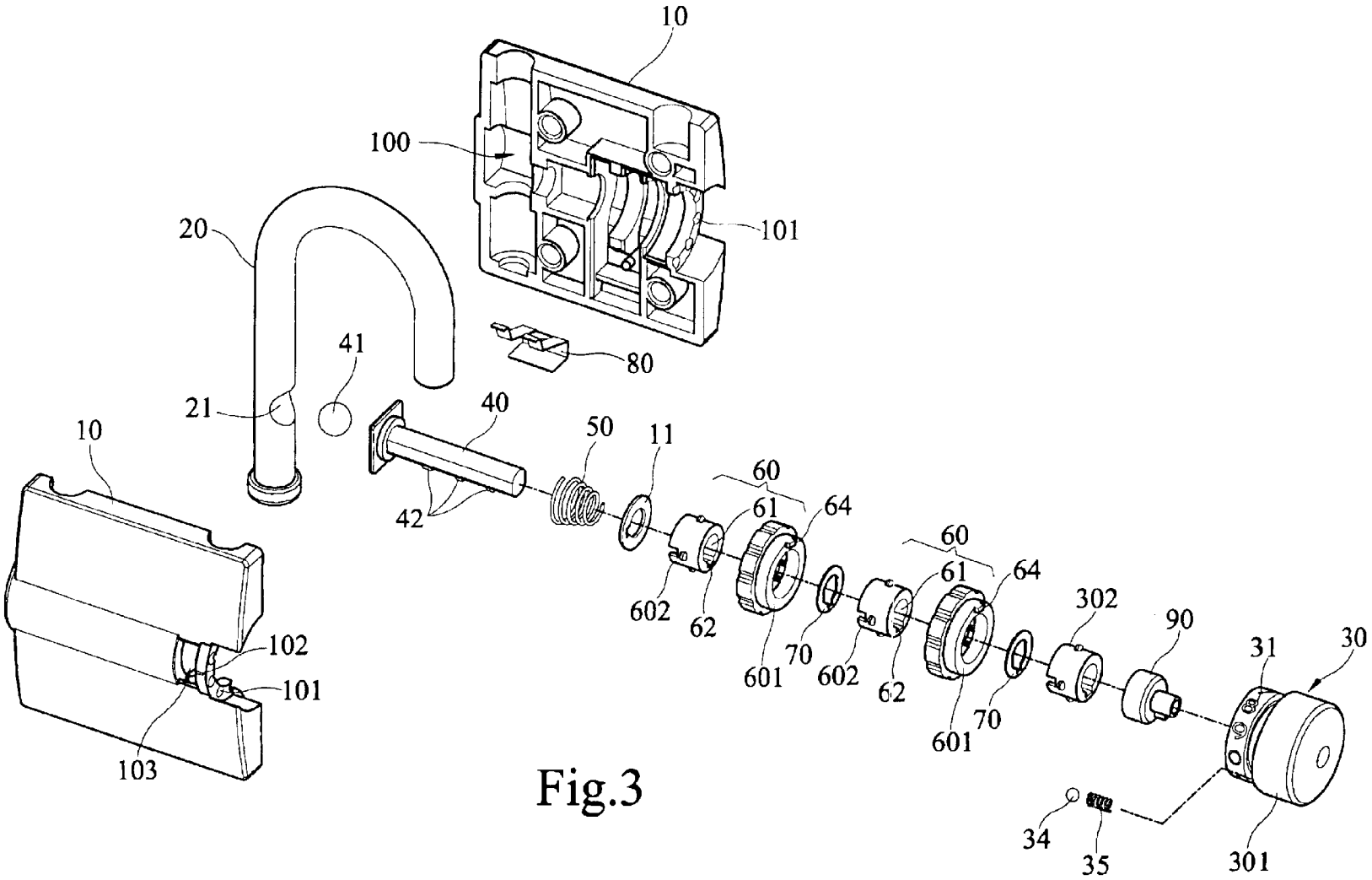
FIG. 3 is an exploded view according to FIG. 2A.
Figure 4:
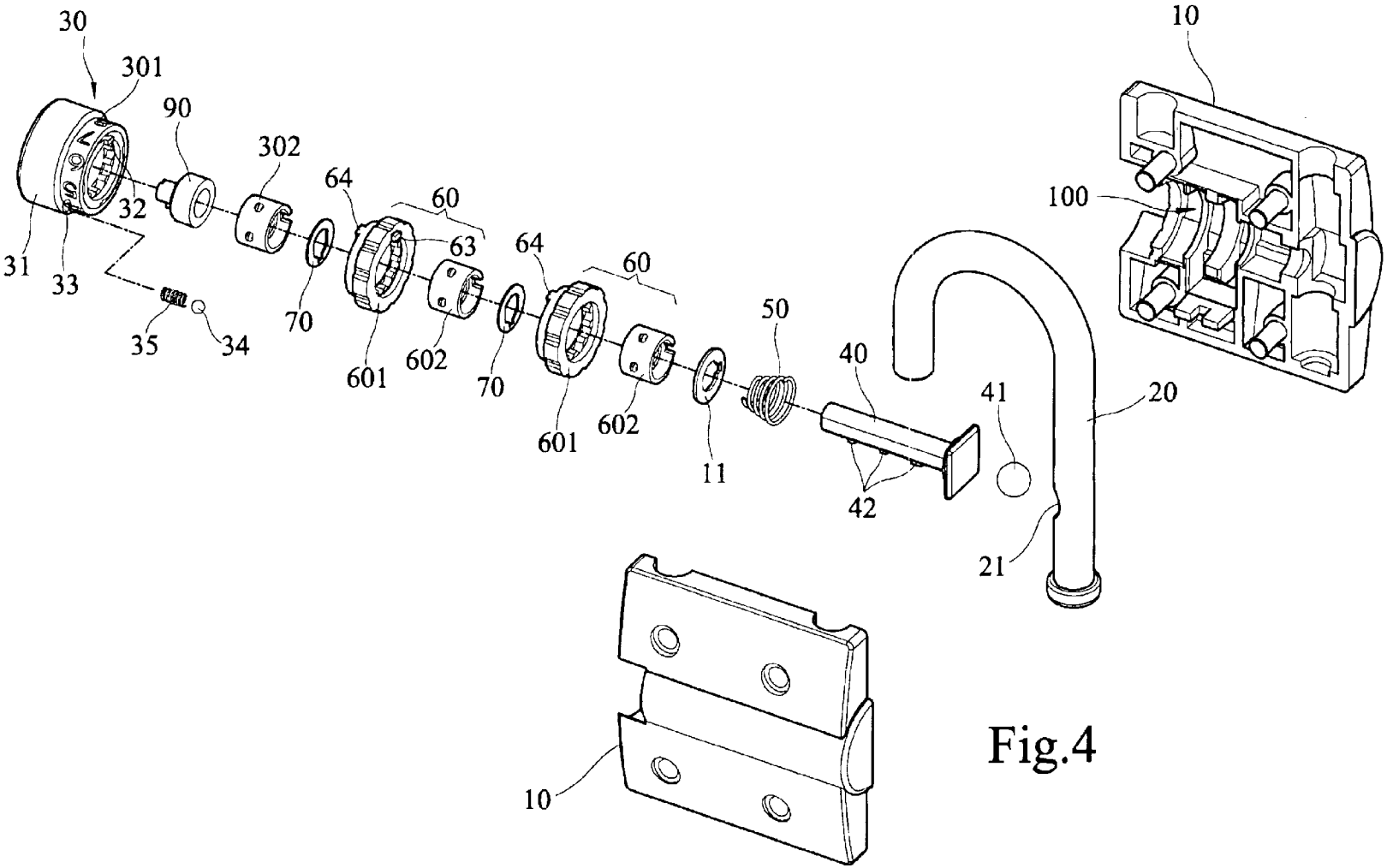
FIG. 4 is another exploded view according to FIG. 2A.
Figure 5A:
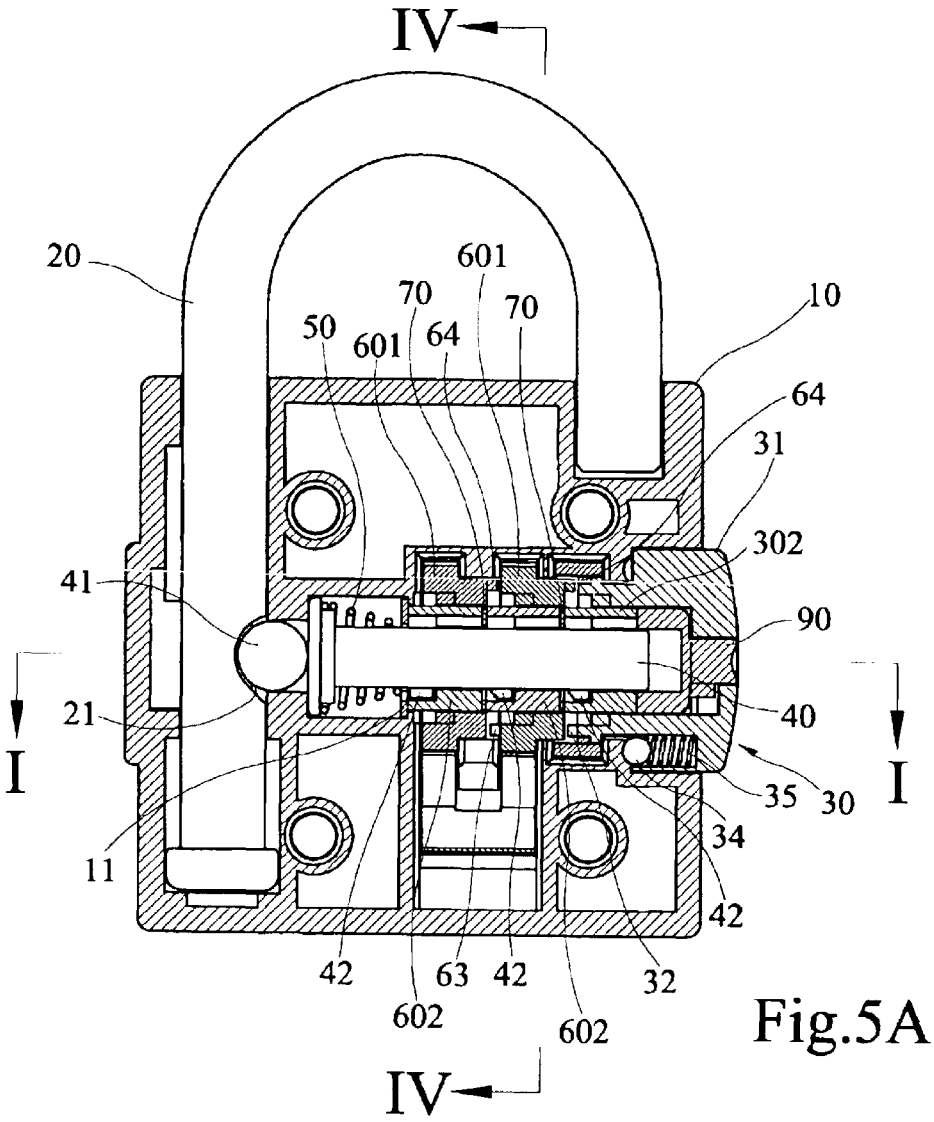
FIG. 5A is a sectional view according to FIG. 2A, showing the shackle in a locked position.
Figure 6A:
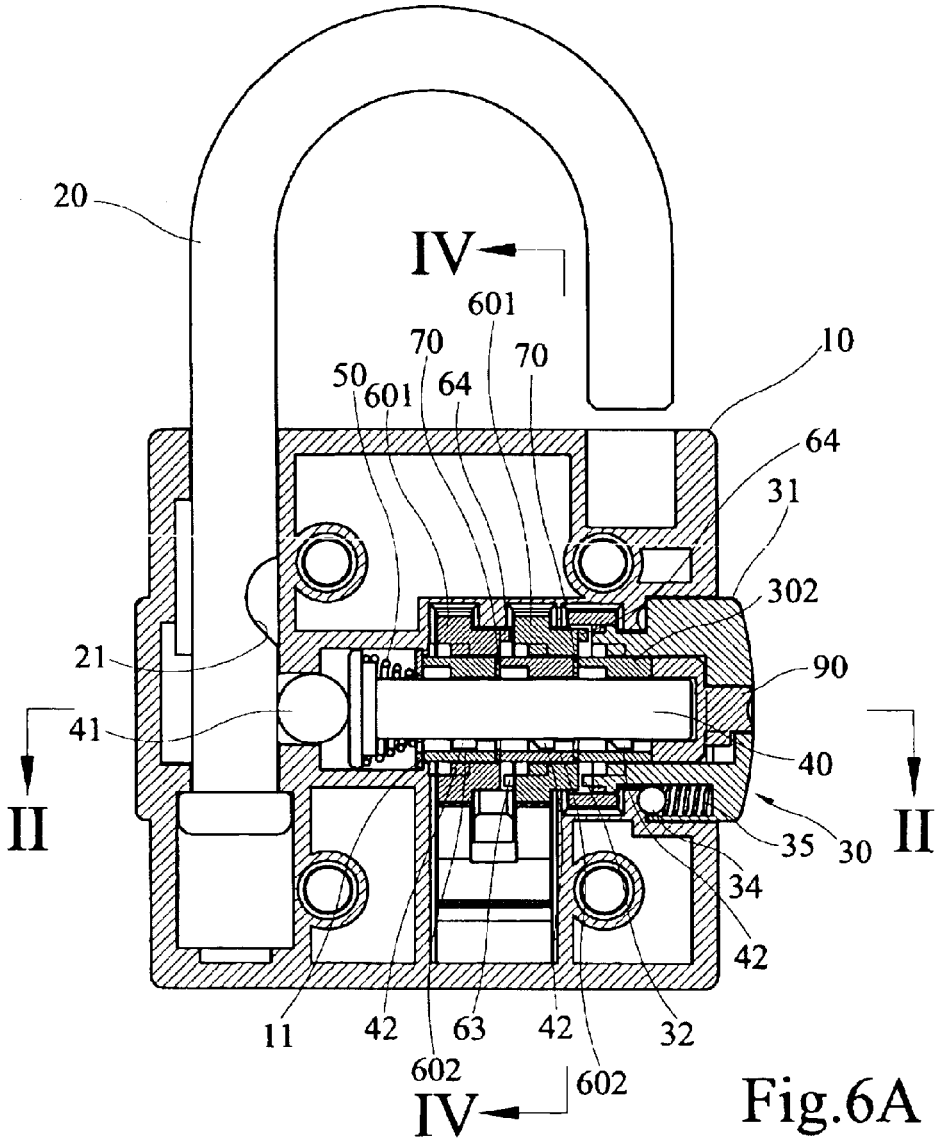
FIG. 6A is a sectional view according to FIG. 2A, showing the shackle in an unlocked position.

Referring to FIG. 2A for two types of embodiment of the invention, he padlock 1 includes a lock housing 10, a shackle 20 connecting to the lock housing 10 and a dial 30 pivotally engaged with the lock housing 10. Detailed structural elements for the embodiment shown in FIG. 2A are illustrated in FIGS. 3 and 4. The lock housing 10 has a hollow housing chamber 100 formed therein to contain the elements such as the shackle 20 to couple with the lock housing 10. The shackle 20 may be switched between a "locked position" relative to the lock housing 10 shown in FIG. 5A and an "unlocked position" shown in FIG. 6A. The shackle 20 may be made from a rigid or a tough linear material as shown in FIG. 2B. The shackle 20 has at least one end separating from the lock housing 10 while in the "unlocked position". On the other hand, in the "locked condition", the separating end of the shackle 20 is coupled with the lock housing 10.

Figure 5B:
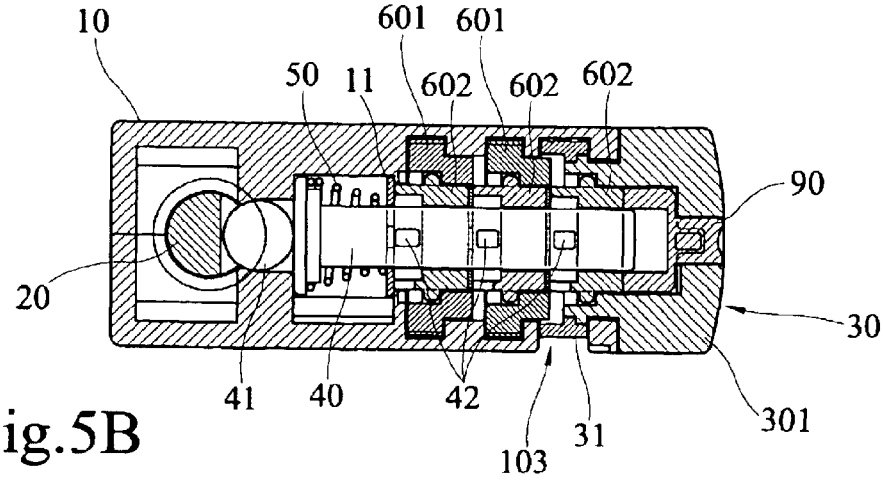
FIG. 5B is a cross section taken along line I—I in FIG. 5A.
Figure 6B:
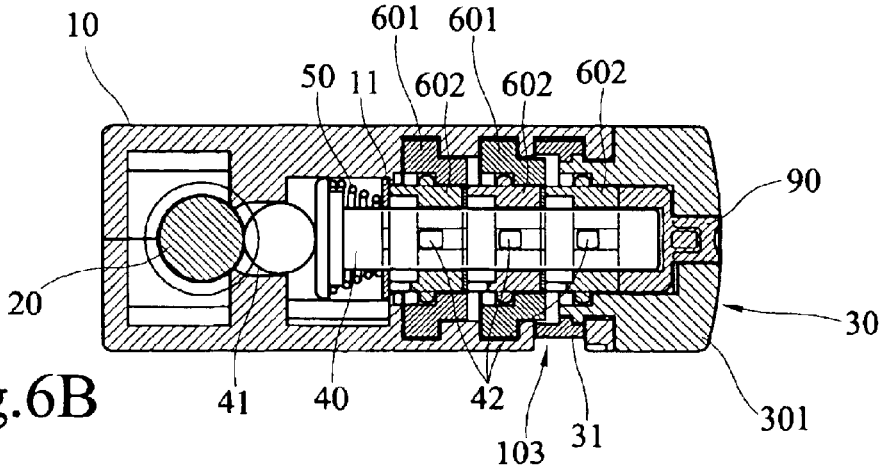
FIG. 6B is a cross section taken along line II—II in FIG. 6A.
Figure 7:
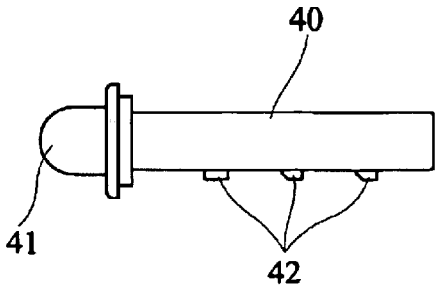
FIG. 7 is a front view of another embodiment of a lock shaft of the invention.

In addition to the shackle 20 and the dial 30, the housing chamber 100 of the lock housing 10 further has a lock shaft 40, an elastic element 50 and a plurality of retaining rings 60. The lock shaft 40 is movable axially in the lock housing 10. It includes a latch 41 located on one end thereof and a plurality of jutting keys 42 located on the peripheral surface. When unconstrained, the lock shaft 40 may be moved relative to the lock housing 10 to a "first position" as shown in FIG. 5B to make the latch 41 to couple with a notch 21 formed on the shackle 20 to restrict the shackle 20 at the "locked position"; or be moved to a "second position" as shown in FIG. 6B to release the moving constraint on the shackle 20. The latch 41 may be an independent element separating from the lock shaft 40, or be integrally formed with the lock shaft 40 (as shown in FIG. 7).

The elastic element 50 may be a spring or a leaf spring with one end pressing the lock shaft 40 and another end pressing a retaining washer 11 wedged in the lock housing 10 to exert an elastic force on the lock shaft 40 so that the lock shaft 40 may remain at the "first position" in the unconstrained condition.

The dial 30 is coupled with the lock housing 10 and turnable. It has at least a portion exposed outside the lock housing 10 to facilitate turning. The surface of the dial 30 has notations 31 (such as characters or patterns) formed thereon in an annular fashion. The dial 30 further has an inner rim with a stub 32 formed thereon.

Figure 9:
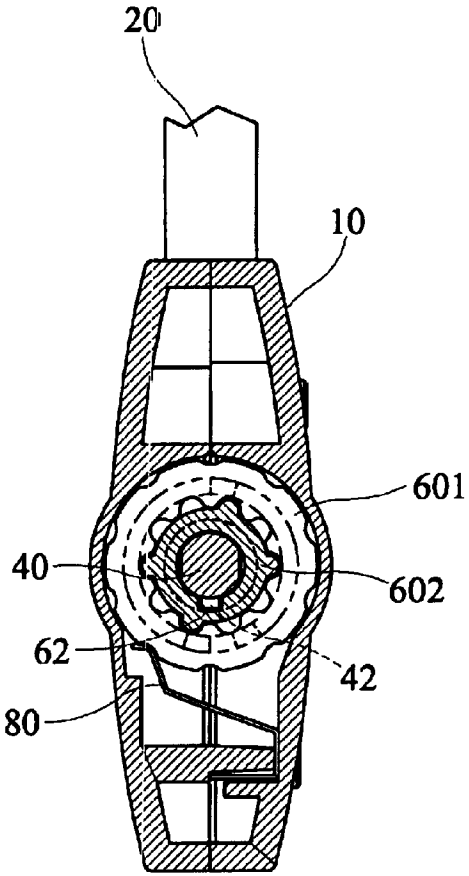
FIG. 9 is a cross section taken along line V—V in FIG. 6A.
Figure 8:
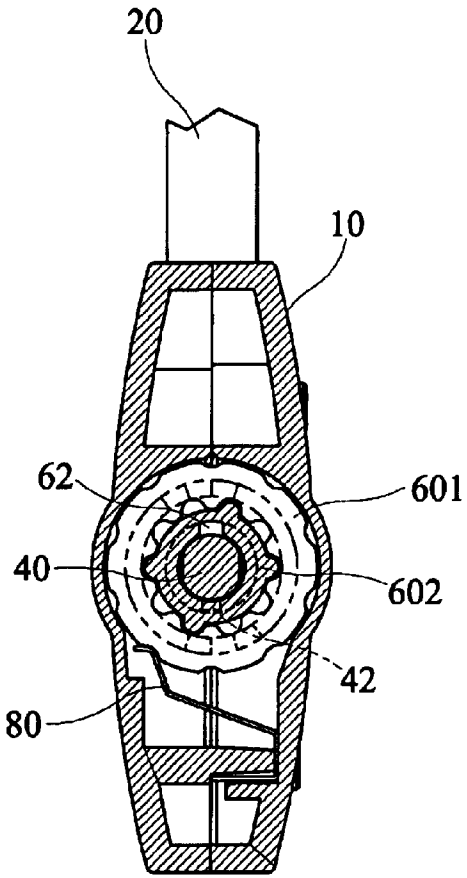
FIG. 8 is a cross section taken along line IV—IV in FIG. 5A.

Each of the retaining rings 60 has an axle hole 61 to receive the lock shaft 40 and a key way 62 mating the jutting key 42. It also has a tab 63 located on one side and a lug 64 located on another side such that the stub 32 of the dial 30 can drive the lug 64 of an adjacent retaining ring 60 and the tab 63 of the same retaining ring 60 can drive the lug 64 of another adjacent retaining ring 60 thereby to establish a chain rotation relationship between the dial 30 and the retaining rings 60. In other words, the retaining rings 60 can receive the driving of the dial 30 and move to an "interference position" (as shown in FIG. 8). The interference position is where the key way 62 does not correspond to the jutting key 42 after having been moved with the retaining rings 60 so that the lock shaft 40 is prevented from moving to the second position. Of course, the retaining rings 60 also may be driven to a "release position" (as shown in FIG. 9) with the key way 62 corresponding to the jutting key 42 and to allow the lock shaft 40 be moved to the second position.

Figure 10A:
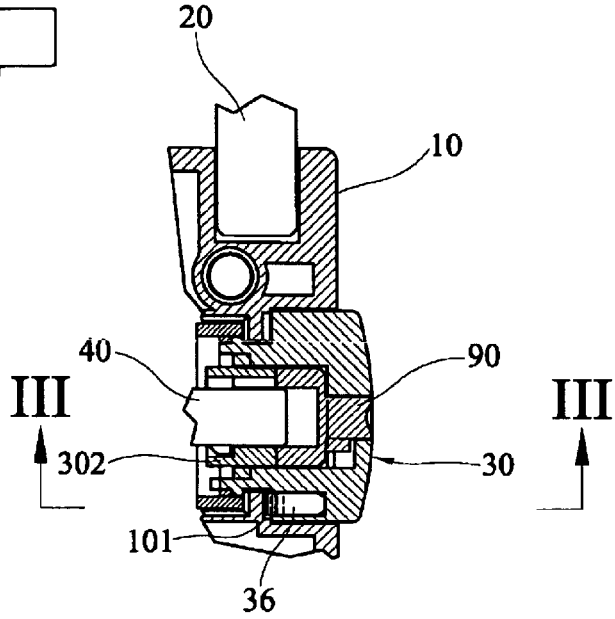
FIG. 10A is a schematic view of an embodiment of a sensor mechanism of the invention.
Figure 10B:
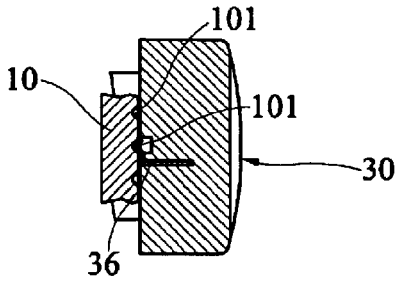
FIG. 10B is a cross section taken along line III—III in FIG. 10A.

In addition to the elements set forth above, as shown in the drawings in the embodiments, there are a plurality of spacers 70 located between the retaining rings 60 and the dial 30, and a sensor blade 80. The spacers 70 are to separate the retaining rings 60 from the dial 30 to prevent them from sticking to each other and incurring faulty contact and chain rotation. The sensor blade 80 is to detect the correct rotating direction and position of the retaining rings 60. With the sensor blade 80 located in the lock housing 10, the outer rims of the retaining rings 60 may be embossed with marks 65 to contact the sensor blade 80 so that when the retaining rings 60 are driven by the dial 30 and rotate, the sensor blade 80 may sense the rotational positions of the retaining rings 60. The design of the rotational position sensing for the retaining rings 60 may also be extended and adopted for the dial 30. Another approach is to include a separate sensor mechanism on the adjoining interface of the dial 30 and lock housing 10. The sensor mechanism may include a plurality of grooves 101 located annularly in the lock housing 10 and a latch element 34 and an elastic member 35 located in a cavity 33 formed on the dial 30. The elastic member 35 may exert an elastic force on the latch element 34 to press an adjoining surface of the lock housing 10. The grooves 101 and the surface has an elevation difference to allow users to sense the turning direction and position of the dial 30. Of course, the sensor mechanism may also be an elastic strip 36 planted on the dial 30 to press the grooves 101 to replace the latch element 34 and the elastic member 35, as shown in FIGS. 10A and 10B.

By means of the construction set forth above, when any of the retaining rings 60 is driven by the dial 34 and rotates, and the key way 62 do not correspond to the jutting key 42 to reach the interference position, the lock shaft 40 is confined at the first position, and the shackle 20 is constrained by the latch 41 and cannot be moved to the unlocked position. On the other hand, when all of the retaining rings 60 are driven to make the key ways 62 corresponding to the jutting keys 42 (i.e. release position), the jutting keys 42 are not constrained by the movements of the retaining rings 60, hence the lock shaft 40 is forced and retracted to the second position, and the shackle 20 is moved to the unlocked position. In summary, whether the shackle 20 may be moved from the locked position to the unlocked position depends on whether the retaining rings 60 are driven by the dial 30 to the selected positions.

The function of the dial 30 to drive and move the retaining rings 60 to the release position mainly is determined by the notations 31 formed on the dial 30. As shown in FIG. 2B, the notations 31 are visible from outside of the lock housing 10. In addition, the lock housing 10 has an alignment pointer 102 adjacent to the notations 31 for aligning purpose. When the notations 31 on the dial 30 adopt a hidden design and are located inside the lock housing 10 as shown in FIG. 2A, an alignment window 103 may be formed on the lock housing 10 to make the notations 31 visible from outside. In the event of the dimension of the alignment window 103 can accommodate two or more notations, a pair of alignment pointers 102 may be added to facilitate alignment. If the alignment window 103 can show only one notation 31, and faulty reading can be avoided, the alignment pointer 102 may be omitted.

Figure 11:
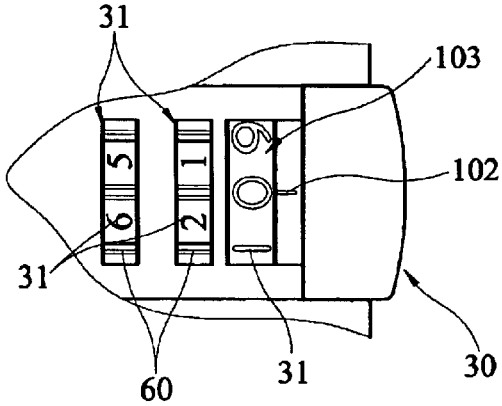
FIG. 11 is a schematic view of an embodiment of an alignment window of the invention.

Of course, if the outer rims of the retaining rings 60 also have the notations 31 formed thereon, a separated alignment window 103 may be formed on the lock housing 10 to mate each notation 31 (as shown in FIG. 11), or an alignment window 103 capable of showing all notations 31 may be formed.

Figure 12A:
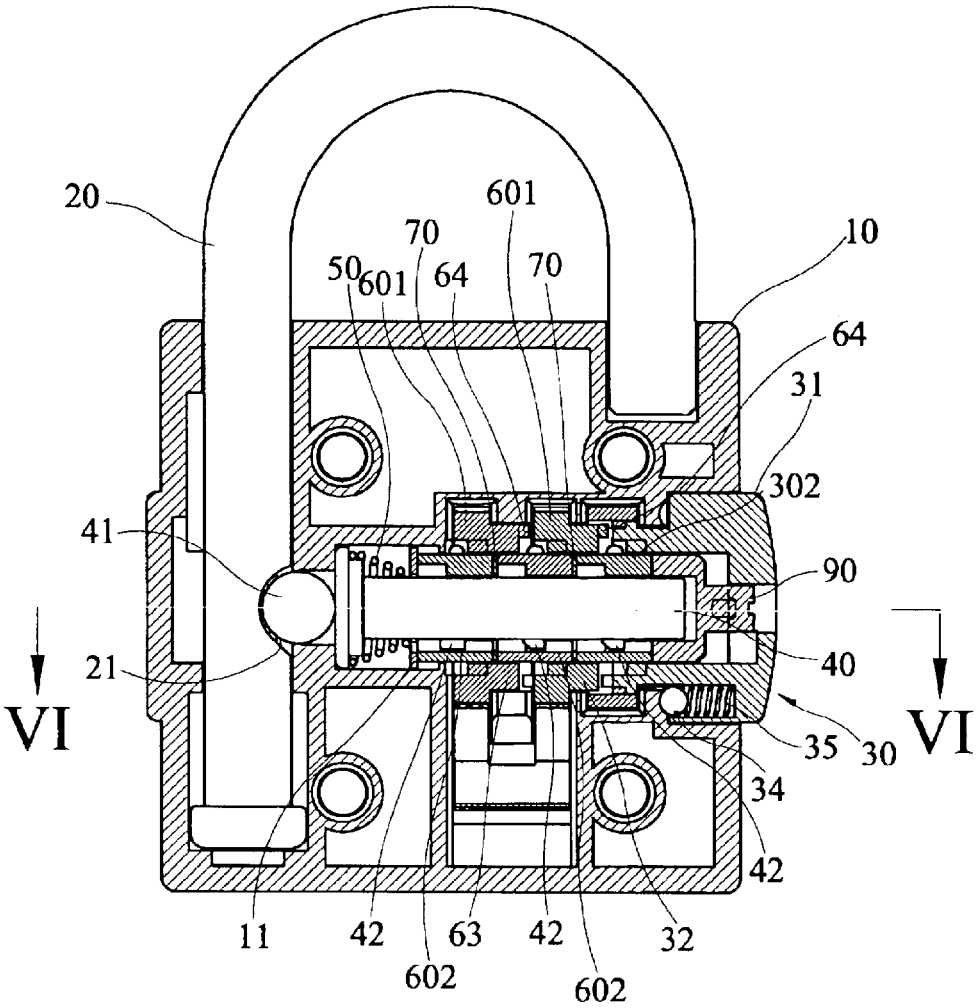
FIG. 12A is a cross section of the invention in a number altering condition.
Figure 12B:
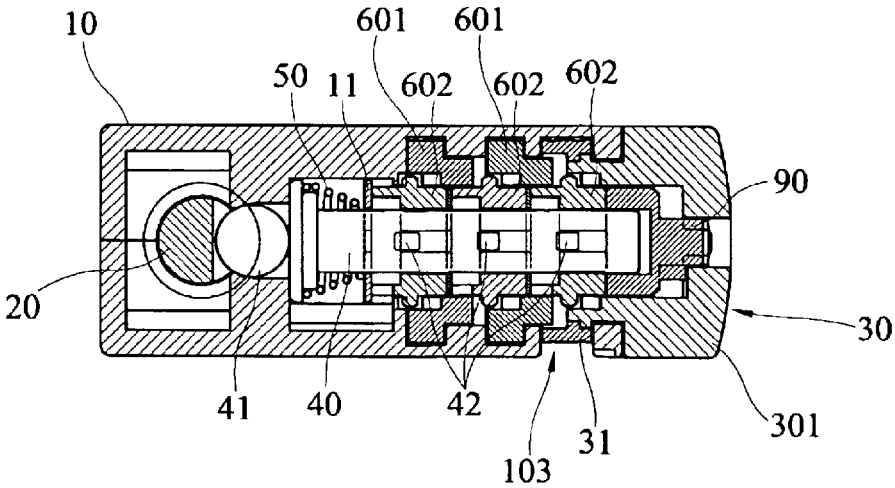
FIG. 12B is a cross section taken along line VI—VI in FIG. 11A.

Refer to FIGS. 3 and 4 for a padlock 1 with alterable numbers. The dial 30 and the retaining rings 60 include respectively a turning wheel 301, 601, and a sleeve 302, 602 sliding with the turning wheel 301, 601 and also coupling with the lock shaft 40 in a series manner. The sleeve 302, 602 have one side connecting to a number alteration bolt 90 in a series manner. When the number alteration bolt 90 is subjected to a force and presses the sleeve 302, 602 as shown in FIGS. 12A and 12B, the sleeves 302, 602 are driven and separated from the turning wheels 301, 601, thus the turning wheels 301, 601 may be turned freely to change the password of the lock. After the password has been changed, the force applying on the sleeve 302, 602 from the number alteration bolt 90 may be released, and the sleeve 302, 602 may return and slidably couple with the turning wheel 301, 601 again.

In summary, the combination lock of the invention performs locking and unlocking function through one single dial. It has a simpler structure and is easier to use than conventional combination locks. It also has a simple number alteration means that is easy to operate.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A combination lock comprising:

a lock housing having a housing chamber, the lock housing extending in a longitudinal direction;

a shackle connecting to the lock housing and being movable in the longitudinal direction relative to the lock housing to an unlocked position and a locked position;

a lock shaft located in the housing chamber being movable in a direction perpendicular to the longitudinal direction relative to the lock housing to a first position to constrain the shackle at the locked position and to a second position to release the shackle from the constraint of movement;

an elastic element located in the housing chamber to exert an elastic force on the lock shaft to keep the lock shaft at the first position in normal conditions;

a dial connecting to the lock housing in a turnable manner; and at least one retaining ring located in the housing chamber to receive driving of the dial to move to an interference position to stop the lock shaft from moving to the second position and to move to a release position to allow the lock shaft moving to the second position, the at least one retaining ring being mounted on and rotatable about the lock shaft.

2. The combination lock of claim 1, wherein the retaining ring is coupled on the lock shaft and has a key way mating a jutting key located on the lock shaft, the key way and the jutting key corresponding to each other when the retaining ring being moved to the release position to allow the lock shaft moving to the second position.

3. The combination lock of claim 2, wherein the dial and the retaining ring include respectively a turning wheel and a sleeve slidably with the turning wheel and coupled on the lock shaft.

4. The combination lock of claim 3, wherein the sleeve have respectively one side connecting to a number alteration bolt in a series manner for receiving a force to drive the sleeve to escape from the turning wheel.

5. The combination lock of claim 1, wherein the retaining ring has marks formed thereon and the lock housing has a sensor blade to press the marks.

6. The combination lock of claim 1, wherein the lock shaft constrains indirectly the shackle on the locked position through a latch.

7. The combination lock of claim 1, wherein the dial has a stub and the retaining ring has a tab and a lug to form a chain movement.

8. The combination lock of claim 1, wherein the retaining rings are interposed by a spacer.

9. The combination lock of claim 1, wherein the dial has notations exposed outside the lock housing and the lock housing has an alignment pointer for aligning the notations.

10. The combination lock of claim 9, wherein the retaining ring has notations formed on the peripheral rim thereof and the lock housing has at least one alignment window for viewing the notations.

11. The combination lock of claim 1, wherein the dial has notations hidden in the lock housing and the lock housing has an alignment window for viewing the notations.

12. The combination lock of claim 11, wherein the lock housing has an alignment pointer for aligning the notations.

13. The combination lock of claim 11, wherein the retaining ring has notations formed on the peripheral rim thereof and the lock housing has at least one alignment window for viewing the notations.

14. The combination lock of claim 1 further having a sensor mechanism located on an interface between the dial and the lock housing, the sensor mechanism including:

a plurality of grooves formed annularly in the lock housing;

a latch element located in a cavity formed on the dial; and an elastic member located in the cavity to push the latch element into the grooves.

15. The combination lock of claim 1 further having a sensor mechanism located on an interface between the dial and the lock housing, the sensor mechanism including:

a plurality of grooves formed annularly in the lock housing; and an elastic strip mounted onto the dial for pressing the grooves.

16. The combination lock of claim 1, wherein the elastic element urges the lock shaft in the direction perpendicular to the longitudinal direction.

17. The combination lock of claim 2, wherein the jutting key extends in the longitudinal direction.

18. The combination lock of claim 16, wherein the elastic element urges the lock shaft in the direction perpendicular to the longitudinal direction.

* * * * *